US008194060B2

(12) United States Patent
Huang et al.

(10) Patent No.: US 8,194,060 B2
(45) Date of Patent: Jun. 5, 2012

(54) DISPLAY SYSTEM

(75) Inventors: Hsien-Ting Huang, Tainan County (TW); Yaw-Guang Chang, Tainan County (TW)

(73) Assignee: Himax Technologies Limited, Fonghua Village, Xinshi Dist., Tainan (TW)

( * ) Notice: Subject to any disclaimer, the term of this patent is extended or adjusted under 35 U.S.C. 154(b) by 728 days.

(21) Appl. No.: 12/370,585

(22) Filed: Feb. 12, 2009

(65) Prior Publication Data

US 2010/0103150 A1 Apr. 29, 2010

Related U.S. Application Data

(60) Provisional application No. 61/109,193, filed on Oct. 29, 2008.

(51) Int. Cl.
*G09G 5/00* (2006.01)
*G09G 3/36* (2006.01)

(52) U.S. Cl. ..... 345/205; 345/204; 345/92

(58) Field of Classification Search ..... 345/76, 345/92, 147, 204, 205
See application file for complete search history.

(56) References Cited

U.S. PATENT DOCUMENTS 7,110,274 B1 9/2006 Endo
7,212,182 B2 * 5/2007 Chiang et ..... 345/92
2003/0011586 A1 1/2003 Nakajima
2005/0099374 A1 5/2005 Sagawa
2006/0012585 A1 * 1/2006 Schoofs et al. ..... 345/204
2007/0024564 A1 2/2007 Shimizu
2007/0132678 A1 6/2007 Wei
2008/0036752 A1 2/2008 Diab
2008/0084410 A1 4/2008 Uehara

FOREIGN PATENT DOCUMENTS

CN 1410813 A 4/2003
CN 1419733 A 5/2003
CN 1664887 A 9/2005
CN 101064467 A 10/2007
CN 101136586 A 3/2008

* cited by examiner

*Primary Examiner* — Hoa T Nguyen
*Assistant Examiner* — Andrew Sasinowski
(74) *Attorney, Agent, or Firm* — Winston Hsu; Scott Margo

(57) ABSTRACT

A display system includes a display device, a driving circuit, a flexible printed circuit (FPC), and a charge pump circuit. The driving circuit is disposed on the display device for driving the display device. The FPC is externally coupled to the display device. The charge pump circuit is disposed on the FPC for generating at least an output voltage to the driving circuit according to an input voltage. The charge pump circuit has at least one control line coupled to the driving circuit for receiving a control signal generated from the driving circuit, and the charge pump circuit sets a pumping factor according to the control signal.

24 Claims, 4 Drawing Sheets

DISPLAY SYSTEM

CROSS REFERENCE TO RELATED APPLICATIONS

This application claims the benefit of U.S. Provisional Application No. 61/109,193, which was filed on Oct. 29, 2008 and is incorporated herein by reference.

BACKGROUND OF THE INVENTION

1. Field of the Invention

The present invention relates to a display system, and more particularly, to a display system disposing a charge pump circuit on a flexible printed circuit (FPC) externally coupled to its display device for improving its voltage converting efficiency.

2. Description of the Prior Art

In traditional small-sized and medium-sized thin-film transistor liquid crystal display (TFT-LCD) devices, with the growing size of the screen, the current consumption is also growing. At this time, if the charge pump circuit is disposed in the driving circuit of the TFT-LCD device, its voltage converting efficiency will be getting worse due to being limited by the indium tin oxide (ITO) resistors.

In addition, since the system end hopes to provide an input voltage ranging from 2.0V to 4.8V to the driving circuit of the TFT-LCD device directly, so the charge pump circuit shall be able to support a voltage converting ratio with different multiples (such as 1.5 times, 2 times, or 3 times) to provide the desired output voltage. If the charge pump circuit is moved from the driving circuit of the TFT-LCD device to a flexible printed circuit (FPC), it is necessary to consider how to control operations of the charge pump circuit on the FPC.

SUMMARY OF THE INVENTION

It is one of the objectives of the claimed invention to provide a display system to solve the abovementioned problems.

According to one embodiment, a display system is provided. The display system includes a display device, a driving circuit, a flexible printed circuit (FPC), and a charge pump circuit. The driving circuit is disposed on the display device for driving the display device. The FPC is externally coupled to the display device. The charge pump circuit is disposed on the FPC for generating at least an output voltage to the driving circuit according to an input voltage. The charge pump circuit has at least one control line coupled to the driving circuit for receiving a control signal generated from the driving circuit, and the charge pump circuit sets a pumping factor according to the control signal.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular components. As one skilled in the art will appreciate, hardware manufacturers may refer to a component by different names. This document does not intend to distinguish between components that differ in name but in function. In the following discussion and in the claims, the terms "include", "including", "comprise", and "comprising" are used in an open-ended fashion, and thus should be interpreted to mean "including, but not limited to . . . ". The terms "couple" and "coupled" are intended to mean either an indirect or a direct electrical connection. Thus, if a first device couples to a second device, that connection may be through a direct electrical connection, or through an indirect electrical connection via other devices and connections.

Figure 1:
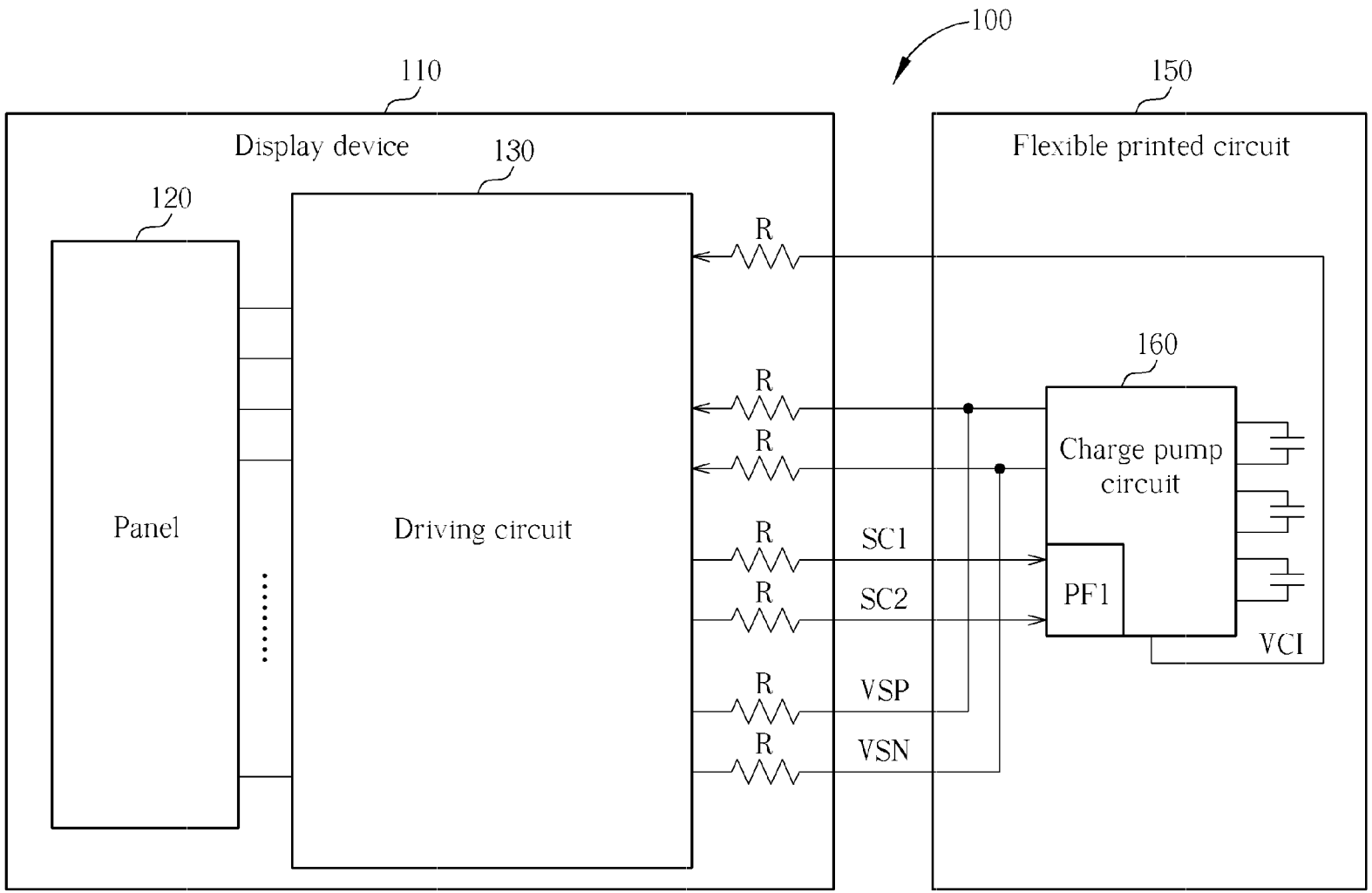
FIG. 1 is a diagram of a display system according to a first embodiment of the present invention.

Please refer to FIG. 1. FIG. 1 is a diagram of a display system 100 according to an embodiment of the present invention. The display system 100 includes, but is not limited to, a display device 110, a panel 120, a driving circuit 130, a flexible printed circuit 150, and a charge pump circuit 160. The panel 120 is disposed on the display device 110. The driving circuit 130 is also disposed on the display device 110 for driving the display device 110. The flexible printed circuit 150 is externally coupled to the display device 110. The charge pump circuit 160 is disposed on the flexible printed circuit 150 for generating at least an output voltage to the driving circuit 130 according to an input voltage. In this embodiment, the charge pump circuit 160 generates two output voltages VSP and VSN according to an input voltage VCI, wherein the input voltage VCI is a power supply inputted from an external system side of the display system and the output voltages VSP and VSN are transmitted to the driving circuit 130 for usage.

In addition, the charge pump circuit 160 has at least one control line coupled to the driving circuit 130 for receiving a control signal generated from the driving circuit 130. In this embodiment, the charge pump circuit 160 has two control lines for receiving two control signals SC1 and SC2. The charge pump circuit 160 sets a pumping factor PF1 according to the control signals SC1 and SC2. Detail components and operations of the driving circuit 130 and the charge pump circuit 160 will be detailed in the following figures and embodiments.

As can be seen from FIG. 1, the charge pump circuit 160 is disposed on the flexible printed circuit 150, but not in the driving circuit 130 of the display device 110. Therefore, the voltage converting efficiency of the charge pump circuit 160 can be substantially improved due to not being limited by the indium tin oxide (ITO) resistors R. Furthermore, only two control signals SC1 and SC2 (the number of the control signals is not limited) are needed to control the voltage converting ratio of the charge pump circuit 160, which minimizes the pin number of the charge pump circuit 160 to achieve a goal of lowering cost.

Please note that the abovementioned display device 110 can be a thin-film transistor liquid crystal display (TFT-LCD) device and the driving circuit 130 can be a TFT-LCD driver IC, but this should not be construed as a limitation of the present invention. In addition, the number of the control lines is not limited.

Figure 2:
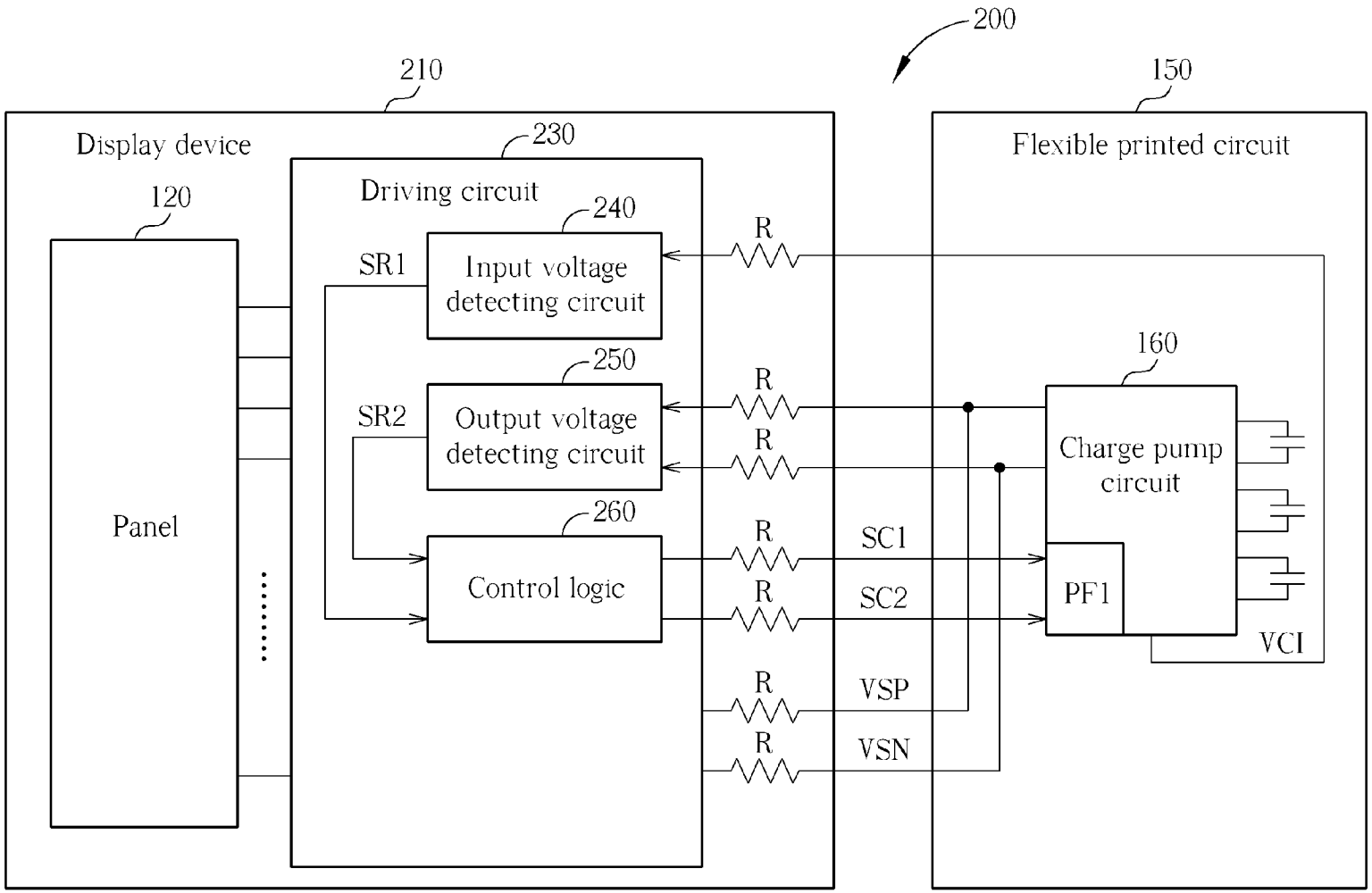
FIG. 2 is a diagram of a display system according to a second embodiment of the present invention.

Please refer to FIG. 2. FIG. 2 is a diagram of a display system 200 according to a second embodiment of the present invention. As shown in FIG. 2, the architecture of the display system 200 is similar to that in FIG. 1, the difference being that a driving circuit 230 of the display device 210 shown in FIG. 2 further includes an input voltage detecting circuit 240, an output voltage detecting circuit 250, and a control logic 260. The input voltage detecting circuit 240 is coupled to the charge pump circuit 160 for detecting the input voltage VCI of the charge pump circuit 160 to generate a first result SRI. The output voltage detecting circuit 250 is coupled to the charge pump circuit 160 for detecting the output voltages VSP and VSN of the charge pump circuit 160 to generate a second result SR2. The control logic 260 is coupled to the input voltage detecting circuit 240 and the output voltage detecting circuit 250 for generating the control signals SC1 and SC2 according to the first result SR1 and the second result SR2. In other words, the driving circuit 230 can provide the control signals SC1 and SC2 to the charge pump circuit 160 for setting the pumping factor PF1 by detecting the input voltage VCI and the output voltages VSP and VSN. Therefore, the charge pump circuit 160 can support the voltage converting ratio with different multiples (such as 1.5 times, 2 times, or 3 times) to provide the desired output voltages VSP/VSN.

Figure 3:
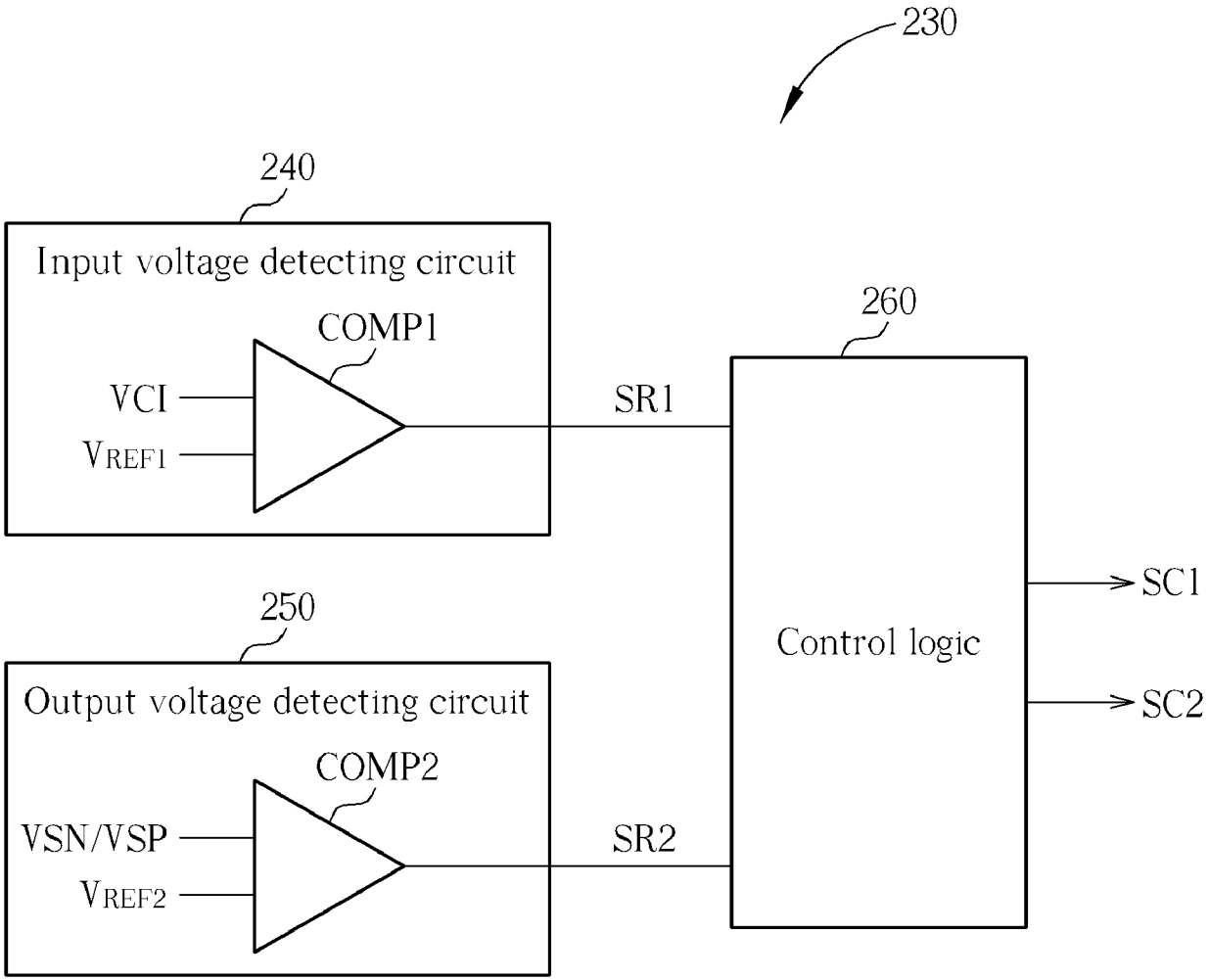
FIG. 3 is a diagram showing an example of the driving circuit shown in FIG. 2

Please refer to FIG. 3. FIG. 3 is a diagram showing an example of the driving circuit 230 shown in FIG. 2. In this embodiment, the input voltage detecting circuit 240 and the output detecting circuit 250 are respectively implemented by a comparator. The input voltage detecting circuit 240 includes a first comparator COMP1 for comparing the input voltage VCI with a first reference voltage $V_{REF1}$ to generate the first result SR1. The output voltage detecting circuit 250 includes a second comparator COMP2 for comparing the output voltage VSP/VSN with a second reference voltage $V_{REF2}$ to generate the second result SR2. Finally, the control logic 260 generates the control signals SC1 and SC2 according to the first result SR1 and the second result SR2.

Please note that the abovementioned embodiments are merely examples for describing the present invention, and in no way should be considered to be limitations of the scope of the present invention. Those skilled in the art should appreciate that various modifications of the driving circuit may be made without departing from the spirit of the present invention, which should also belong to the scope of the present invention. In addition, the first reference voltage $V_{REF1}$ and the second reference voltage $V_{REF2}$ are not fixed values, and can be adjusted depending on practical demands.

Figure 4:
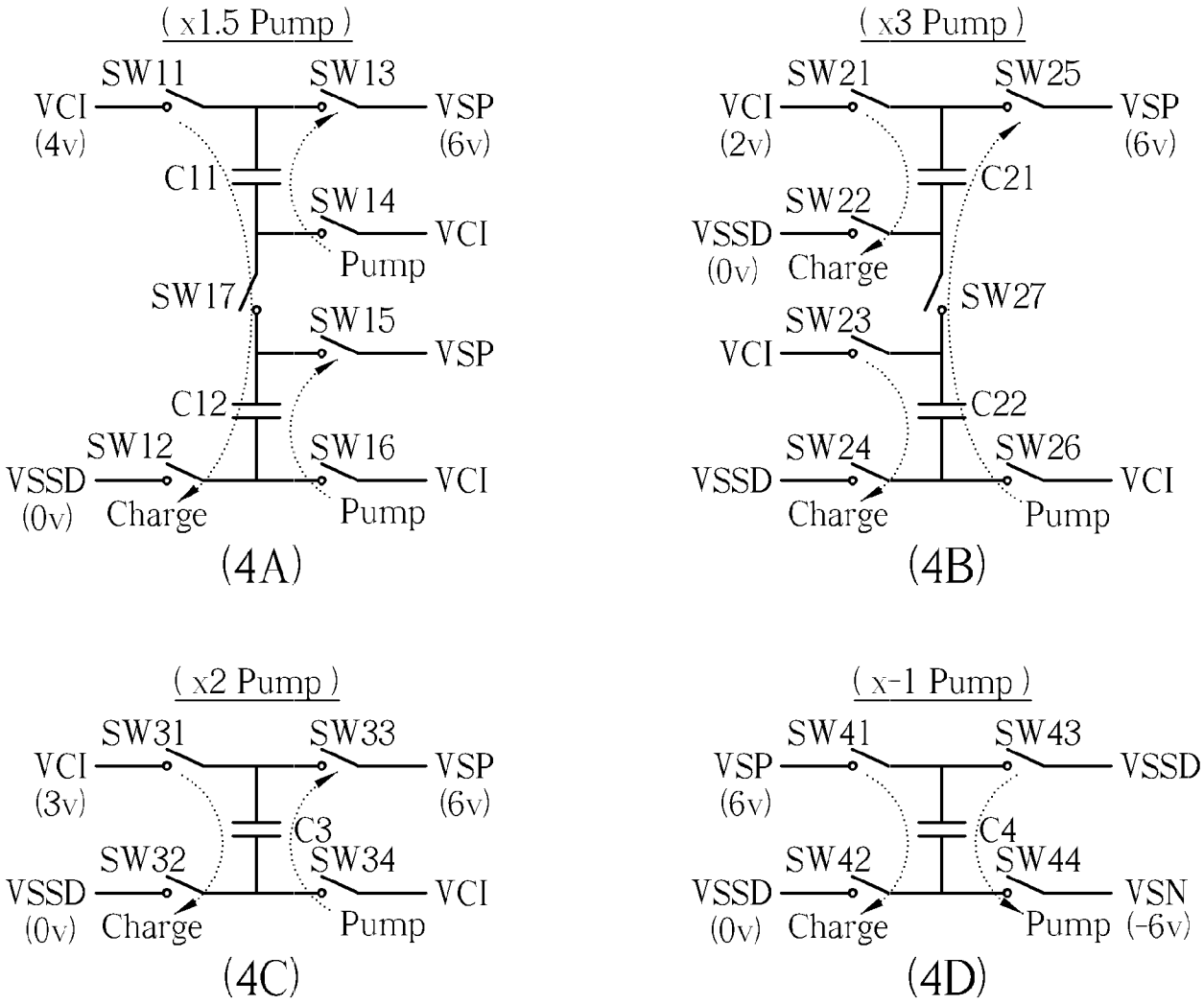
FIG. 4 (including 4A, 4B, 4C, and 4D) is a diagram illustrating examples of the charge pump circuit shown in FIG. 2 with different pumping factors.

Please refer to FIG. 4. FIG. 4 (including 4A, 4B, 4C, and 4D) is a diagram illustrating examples of the charge pump circuit 160 shown in FIG. 2 with different pumping factors. As shown in 4A, the charge pump circuit includes seven switches SW11-SW17 and two capacitors C11 and C12. The connection manner of these switches SW11-SW17 and the two capacitors C11 and C12 is shown in 4A, and further description is omitted here for brevity. In this embodiment, the input voltage VCI is 4V and the output voltage VSP is 6V, and thus the pumping factor PF1 is 1.5. During a charging stage, the first switch SW11, the second switch SW12, and the seventh switch SW17 are turned on while the third switch SW13, the fourth switch SW14, the fifth switch SW15, and the sixth switch SW16 are turned off. During a pumping stage, the third switch SW13, the fourth switch SW14, the fifth switch SW15, and the sixth switch SW16 are turned on while the first switch SW11, the second switch SW12, and the seventh switch SW17 are turned off. Assume that the first capacitor C11 is equal to the second capacitor C12. Therefore, as can be seen from 4A, the first capacitor C11 and the second capacitor C12 can be respectively charged to 2V during the charging stage, and the output voltage VSP can be pumped to 6V during the pumping stage.

As shown in 4B, the charge pump circuit includes seven switches SW21-SW27 and two capacitors C21 and C22. The connection manner of these switches SW21-SW27 and the two capacitors C21 and C22 is shown in 4B, and further description is omitted here for brevity. In this embodiment, the input voltage VCI is 2V and the output voltage VSP is 6V, and thus the pumping factor PF1 is 3. During a charging stage, the first switch SW21, the second switch SW22, the third switch SW23, and the fourth switch SW24 are turned on while the fifth switch SW25, the sixth switch SW26, and the seventh switch SW27 are turned off. During a pumping stage, the fifth switch SW25, the sixth switch SW26, and the seventh switch SW27 are turned on while the first switch SW21, the second switch SW22, the third switch SW23, and the fourth switch SW24 are turned off. Assume that the first capacitor C21 is equal to the second capacitor C22. Therefore, as can be seen from 4B, the first capacitor C21 and the second capacitor C22 can be respectively charged to 2V during the charging stage, and the output voltage VSP can be pumped to 6V during the pumping stage.

As shown in 4C, the charge pump circuit includes four switches SW31-SW34 and a capacitor C3. The connection manner of these switches SW31-SW34 and the capacitor C3 is shown in 4C, and further description is omitted here for brevity. In this embodiment, the input voltage VCI is 3V and the output voltage VSP is 6V, and thus the pumping factor PF1 is 2. During a charging stage, the first switch SW31 and the second switch SW32 are turned on while the third switch SW33 and the fourth switch SW34 are turned off. During a pumping stage, the third switch SW33 and the fourth switch SW34 are turned on while the first switch SW31 and the second switch SW32 are turned off. Therefore, as can be seen from 4C, the capacitor C3 can be charged to 3V during the charging stage, and the output voltage VSP can be pumped to 6V during the pumping stage.

As shown in 4D, the charge pump circuit includes four switches SW41-SW44 and a capacitor C4. The connection manner of these switches SW41-SW44 and the capacitor C4 is shown in 4D, and further description is omitted here for brevity. In this embodiment, the output voltage VSP is 6V and the other output voltage VSN is (−6V), and thus the pumping factor PF1 is (−1). During a charging stage, the first switch SW41 and the second switch SW42 are turned on while the third switch SW43 and the fourth switch SW44 are turned off. During a pumping stage, the third switch SW43 and the fourth switch SW44 are turned on while the first switch SW41 and the second switch SW42 are turned off. Therefore, as can be seen from 4D, the capacitor C4 can be charged to 6V during the charging stage, and the output voltage VSN can be pumped to (−6V) during the pumping stage.

As can be seen from FIG. 4, when the input voltage VCI is ranged from 2.0V to 4V, the charge pump circuit can choose different pumping factors (×1.5, ×3, or ×2) to generate the same output voltage VSP (i.e., 6V). In addition, the charge pump circuit disclosed in the present invention can be implemented by simple logic circuits, capacitors, and switches only. Other complicated circuits, such as bandgap reference circuits, OP amplifiers, and clock generating circuits, can be disposed in the driving circuit. In other words, only a little cost is needed to complete such circuit. Furthermore, the value of the pumping factor PF1 is not limited, and can be adjusted depending on practical designs.

The abovementioned embodiments are presented merely for describing the present invention, and in no way should be considered to be limitations of the scope of the present invention. In summary, the present invention provides a display system disposing the charge pump circuit on the flexible printed circuit externally coupled to the display device. Therefore, the voltage converting efficiency of the charge pump circuit 160 can be substantially improved due to not being limited by the ITO resistors. In addition, only two control signals SC1 and SC2 are needed to control the voltage converting ratio of the charge pump circuit 160, which minimizes the pin number of the charge pump circuit 160 to achieve a goal of lowering cost. Through setting the pumping factor by detecting the input voltage and the output voltages, the charge pump circuit can support the voltage converting ratio with different multiples (such as 1.5 times, 2 times, or 3 times) to provide the desired output voltages. Furthermore, the charge pump circuit disclosed in the present invention can be implemented by simple logic circuits, capacitors, and switches only, which only spends a little cost.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display system, comprising:

a display device;

a driving circuit, disposed on the display device, for driving the display device;

a flexible printed circuit (FPC), externally coupled to the display device; and a charge pump circuit, disposed on the FPC, for generating at least an output voltage to the driving circuit according to an input voltage, wherein the charge pump circuit comprises:

a first capacitor, having a first end and a second end;

a second capacitor, having a first end and a second end;

a first switch, coupled between the input voltage and the first end of the first capacitor;

a second switch, coupled between a reference voltage and the second end of the second capacitor;

a third switch, coupled between the output voltage and the first end of the first capacitor;

a fourth switch, coupled between the input voltage and the second end of the first capacitor;

a fifth switch, coupled between the output voltage and the first end of the second capacitor;

a sixth switch, coupled between the input voltage and the second end of the second capacitor; and a seventh switch, coupled between the second end of the first capacitor and the first end of the second capacitor;

wherein during a charging stage, the first switch, the second switch, and the seventh switch are turned on while the third switch, the fourth switch, the fifth switch, and the sixth switch are turned off; and during a pumping stage, the third switch, the fourth switch, the fifth switch, and the sixth switch are turned on while the first switch, the second switch, and the seventh switch are turned off.

2. The display system of claim 1, wherein the charge pump circuit has at least one control line coupled to the driving circuit for receiving a control signal generated from the driving circuit, and the charge pump circuit sets a pumping factor according to the control signal.

3. The display system of claim 2, wherein the driving circuit comprises:

an input voltage detecting circuit, for detecting the input voltage of the charge pump circuit to generate a first result;

an output voltage detecting circuit, for detecting the output voltage of the charge pump circuit to generate a second result; and a control logic, coupled to the input voltage detecting circuit and the output voltage detecting circuit, for generating the control signal according to the first result and the second result.

4. The display system of claim 3, wherein the input voltage detecting circuit comprises a comparator for comparing the input voltage with a first reference voltage to generate the first result.

5. The display system of claim 3, wherein the output voltage detecting circuit comprises a comparator for comparing the output voltage with a second reference voltage to generate the second result.

6. The display system of claim 1, wherein the display device is a thin-film transistor liquid crystal display (TFT-LCD) device, and the driving circuit is a TFT-LCD driver IC.

7. A display system, comprising:

a display device;

a driving circuit, disposed on the display device, for driving the display device;

a flexible printed circuit (FPC), externally coupled to the display device; and a charge pump circuit, disposed on the FPC, for generating at least an output voltage to the driving circuit according to an input voltage, wherein the charge pump circuit comprises:

a first capacitor, having a first end and a second end;

a second capacitor, having a first end and a second end;

a first switch, coupled between the input voltage and the first end of the first capacitor;

a second switch, coupled between a reference voltage and the second end of the first capacitor;

a third switch, coupled between the input voltage and the first end of the second capacitor;

a fourth switch, coupled between the reference voltage and the second end of the second capacitor;

a fifth switch, coupled between the output voltage and the first end of the first capacitor;

a sixth switch, coupled between the input voltage and the second end of the second capacitor; and a seventh switch, coupled between the second end of the first capacitor and the first end of the second capacitor;

wherein during a charging stage, the first switch, the second switch, the third switch, and the fourth switch are turned on while the fifth switch, the sixth switch, and the seventh switch are turned off; and during a pumping stage, the fifth switch, the sixth switch, and the seventh switch are turned on while the first switch, the second switch, the third switch, and the fourth switch are turned off.

8. The display system of claim 7, wherein the charge pump circuit has at least one control line coupled to the driving circuit for receiving a control signal generated from the driving circuit, and the charge pump circuit sets a pumping factor according to the control signal.

9. The display system of claim 8, wherein the driving circuit comprises:

an input voltage detecting circuit, for detecting the input voltage of the charge pump circuit to generate a first result;

an output voltage detecting circuit, for detecting the output voltage of the charge pump circuit to generate a second result; and a control logic, coupled to the input voltage detecting circuit and the output voltage detecting circuit, for generating the control signal according to the first result and the second result.

10. The display system of claim 9, wherein the input voltage detecting circuit comprises a comparator for comparing the input voltage with a first reference voltage to generate the first result.

11. The display system of claim 9, wherein the output voltage detecting circuit comprises a comparator for comparing the output voltage with a second reference voltage to generate the second result.

12. The display system of claim 7, wherein the display device is a thin-film transistor liquid crystal display (TFT-LCD) device, and the driving circuit is a TFT-LCD driver IC.

13. A display system, comprising:

a display device;

a driving circuit, disposed on the display device, for driving the display device;

a flexible printed circuit (FPC), externally coupled to the display device; and a charge pump circuit, disposed on the FPC, for generating at least an output voltage to the driving circuit according to an input voltage, wherein the charge pump circuit comprises:

a capacitor, having a first end and a second end;

a first switch, coupled between the input voltage and the first end of the capacitor;

a second switch, coupled between a reference voltage and the second end of the capacitor;

a third switch, coupled between the output voltage and the first end of the capacitor; and a fourth switch, coupled between the input voltage and the second end of the capacitor;

wherein during a charging stage, the first switch and the second switch are turned on while the third switch and the fourth switch are turned off; and during a pumping stage, the third switch and the fourth switch are turned on while the first switch and the second switch are turned off.

14. The display system of claim 13, wherein the charge pump circuit has at least one control line coupled to the driving circuit for receiving a control signal generated from the driving circuit, and the charge pump circuit sets a pumping factor according to the control signal.

15. The display system of claim 14, wherein the driving circuit comprises:

an input voltage detecting circuit, for detecting the input voltage of the charge pump circuit to generate a first result;

an output voltage detecting circuit, for detecting the output voltage of the charge pump circuit to generate a second result; and a control logic, coupled to the input voltage detecting circuit and the output voltage detecting circuit, for generating the control signal according to the first result and the second result.

16. The display system of claim 15, wherein the input voltage detecting circuit comprises a comparator for comparing the input voltage with a first reference voltage to generate the first result.

17. The display system of claim 15, wherein the output voltage detecting circuit comprises a comparator for comparing the output voltage with a second reference voltage to generate the second result.

18. The display system of claim 13, wherein the display device is a thin-film transistor liquid crystal display (TFT-LCD) device, and the driving circuit is a TFT-LCD driver IC.

19. A display system, comprising:

a display device;

a driving circuit, disposed on the display device, for driving the display device;

a flexible printed circuit (FPC), externally coupled to the display device; and a charge pump circuit, disposed on the FPC, for generating at least an output voltage to the driving circuit according to an input voltage, wherein the charge pump circuit comprises:

a capacitor, having a first end and a second end;

a first switch, coupled between the output voltage and the first end of the capacitor;

a second switch, coupled between a reference voltage and the second end of the capacitor;

a third switch, coupled between the reference voltage and the first end of the capacitor; and a fourth switch, coupled to a second output voltage and the second end of the capacitor;

wherein during a charging stage, the first switch and the second switch are turned on while the third switch and the fourth switch are turned off; and during a pumping stage, the third switch and the fourth switch are turned on while the first switch and the second switch are turned off.

20. The display system of claim 19, wherein the charge pump circuit has at least one control line coupled to the driving circuit for receiving a control signal generated from the driving circuit, and the charge pump circuit sets a pumping factor according to the control signal.

21. The display system of claim 20, wherein the driving circuit comprises:

an input voltage detecting circuit, for detecting the input voltage of the charge pump circuit to generate a first result;

an output voltage detecting circuit, for detecting the output voltage of the charge pump circuit to generate a second result; and a control logic, coupled to the input voltage detecting circuit and the output voltage detecting circuit, for generating the control signal according to the first result and the second result.

22. The display system of claim 21, wherein the input voltage detecting circuit comprises a comparator for comparing the input voltage with a first reference voltage to generate the first result.

23. The display system of claim 21, wherein the output voltage detecting circuit comprises a comparator for comparing the output voltage with a second reference voltage to generate the second result.

24. The display system of claim 19, wherein the display device is a thin-film transistor liquid crystal display (TFT-LCD) device, and the driving circuit is a TFT-LCD driver IC.

* * * * *